US011548692B2

(12) United States Patent
Lenz et al.

(10) Patent No.: US 11,548,692 B2
(45) Date of Patent: Jan. 10, 2023

(54) CLOSURE FOR A CONTAINER WITH FLEXIBLE FEATURES

(71) Applicant: AptarGroup, Inc., Crystal Lake, IL (US)

(72) Inventors: Franz Lenz, Hinterschmiding (DE); Gerhard Jaeckel, Freyung (DE)

(73) Assignee: AptarGroup, Inc., Crystal Lake, IL (US)

( * ) Notice: Subject to any disclaimer, the term of this patent is extended or adjusted under 35 U.S.C. 154(b) by 68 days.

(21) Appl. No.: 17/259,731

(22) PCT Filed: Dec. 7, 2018

(86) PCT No.: PCT/US2018/064465
§ 371 (c)(1),
(2) Date: Jan. 12, 2021

(87) PCT Pub. No.: WO2020/096629
PCT Pub. Date: May 14, 2020

(65) Prior Publication Data

US 2021/0347533 A1 Nov. 11, 2021

Related U.S. Application Data

(60) Provisional application No. 62/755,855, filed on Nov. 5, 2018.

(51) Int. Cl.
*B65D 43/16* (2006.01)
*B65D 51/24* (2006.01)

(52) U.S. Cl.
CPC ..... *B65D 43/169* (2013.01); *B65D 51/246* (2013.01)

(58) Field of Classification Search
CPC ..... B65D 47/2031; B65D 41/3428; B65D 2251/0025; B65D 2251/0093;
(Continued)

(56) References Cited

U.S. PATENT DOCUMENTS 4,394,918 A * 7/1983 Grussen ..... B65D 41/3428 215/253
4,657,153 A 4/1987 Hayes
(Continued)

FOREIGN PATENT DOCUMENTS

WO 2016022744 A1 2/2016

OTHER PUBLICATIONS

International Search Report and Written Opinion dated Mar. 11, 2019.

*Primary Examiner* — Don M Anderson
(74) *Attorney, Agent, or Firm* — Wood, Phillips, Katz, Clark & Mortimer

(57) ABSTRACT

A closure (20, 20A, 20B) for a container (22) with an outwardly projecting flange (25). The closure including a skirt (50, 50A, 50B) for attaching the closure (20, 20A, 20B) to the container (22). The skirt (50, 50A, 50B) has an annular, flexible retention member (66, 66A) extending laterally inwardly from a lower end portion (54, 54A, 54B) of the skirt (50, 50A, 50B) to define a connection (62, 62A, 62B) therebetween. In one form, the flexible retention member (58, 58A, 58B) has (a) an initial, undeflected configuration, (b) a deflected configuration rotated away therefrom about the connection (62, 62A, 62B), and (c) a proximal end surface (126, 126A) located at the connection
(Continued)

(62, 62A, 62B) defining a shoulder when the flexible retention member (58, 58A, 58B) is in the undeflected configuration. In another form, the flexible retention member (58, 58A, 58B) is movable into the deflected configuration when subjected to an axial force of between about 100 Newtons and about 150 Newtons.

17 Claims, 11 Drawing Sheets

(58) Field of Classification Search
CPC .... B65D 2251/105; B65D 2543/00092; B65D 2543/00537; B65D 2543/00564; B65D 2543/00962; B65D 2547/066; B65D 41/3409; B65D 41/3438; B65D 43/0283; B65D 47/0804; B65D 47/0809; B65D 47/0814; B65D 47/0833; B65D 47/0838; B65D 51/145; B65D 41/40; B65D 41/46; B65D 2543/00444; B65D 43/163; B65D 51/246; B65D 2543/00435; B65D 2543/00759; B65D 55/16; B65D 47/20; B65D 43/169; A61M 2039/0072; Y10T 137/7876
See application file for complete search history.

(56) References Cited

U.S. PATENT DOCUMENTS

| | | | | |
|---|---|---|---|---|
| 4,813,561 | A | 3/1989 | Ochs | |
| 5,090,788 | A * | 2/1992 | Ingram | B29C 69/02 215/252 |
| 5,271,531 | A | 12/1993 | Rohr et al. | |
| 5,452,818 | A * | 9/1995 | Yost | B65D 51/20 220/240 |
| 5,769,253 | A | 6/1998 | Gross | |
| 5,971,232 | A | 10/1999 | Rohr et al. | |
| 6,672,487 | B1 | 1/2004 | Lohrman | |
| 7,344,039 | B2 * | 3/2008 | Bixler | B65D 41/3428 215/258 |
| 2007/0017830 | A1 | 1/2007 | Neumeyer et al. | |
| 2008/0105641 | A1 | 5/2008 | Dobbelstein et al. | |
| 2009/0242564 | A1 | 10/2009 | Danks et al. | |
| 2014/0209644 | A1 | 7/2014 | Socier et al. | |
| 2014/0224356 | A1 | 8/2014 | Hatton et al. | |
| 2017/0203890 | A1 * | 7/2017 | Lenz | B65D 51/26 |

* cited by examiner

CLOSURE FOR A CONTAINER WITH FLEXIBLE FEATURES

TECHNICAL FIELD

This invention relates to a closure for a container, and more specifically relates to a closure with one or more features to retain the closure on a container at the container opening.

BACKGROUND OF THE INVENTION AND TECHNICAL PROBLEMS POSED BY THE PRIOR ART

There are a variety of types of conventional closures for containers. One type of closure includes a body for being attached to the top of a container. The closure, container, and product within the container are referred to as a "package". Such a closure can be molded or otherwise manufactured from a suitable material (e.g., a thermoplastic material). Such a closure typically has a hollow body (which may be alternatively described as the closure base or base portion) that, when installed on the open end of a container, defines an opening to the container interior. Such a closure typically also includes a closing element or a lid (which may or may not be hingedly mounted on the closure base) which can be lifted up to expose the container mouth (i.e., the opening defined by the open end of the container). With some such closures, a liner in the form of a removable membrane is disposed across a lower portion of the closure or across the container to initially seal the contents (i.e., a product) from the ambient environment.

For some types of products, it can be desirable to provide a closure that has a base with a relatively large access passage (e.g., opening) which is normally covered with a hinged lid that can prevent access to the product (such as fluent products, as well as non-fluent products), and that, when opened, can accommodate the insertion of a utensil (e.g., scoop, spoon, fork, ladle, etc.) through the opened closure to permit the product to be stirred and/or scooped out of the container with the utensil.

Some containers, especially some types of wide mouth metal and composite containers, have significant manufacturing tolerances with respect to the design dimensions of the container open end, or seam diameter, that defines the container mouth.

Some such containers, especially some types of metal containers, have a open end that may also have some other type of irregularity that is unintentionally created during manufacturing and/or during subsequent processing (e.g., labeling, storage, shipping, etc.) prior to the closure being installed on the container. For example, during shipping of empty metal containers, one or more of the containers could be subjected to an accidental impact that could create a small irregularity (e.g., a deformation or "dent") in a portion of the container end around the mouth of the container.

The inventors of the present invention have determined that a container which has an open end with significant manufacturing tolerances and/or deformations or other irregularities can pose problems with respect to proper installation of a closure, securement of the closure, and/or sealing sealing of the closure. The inventors have found that some prior art closures require relatively large forces to effect installation of the closure upon the container, and that some of the closures of the prior art may be difficult to center or orient on containers, and such closures may require more complex or sophisticated installation machinery and/or may reduce efficiency in assembly of the closure with the container.

The inventors of the present invention have determined that in some applications, the use of a non-removable closure is preferred so as to increase the consumer confidence in the integrity of the package (e.g., by showing evidence of tampering) and to inhibit counterfeiting of the package filled with a substandard product.

The inventors of the present invention have determined that it would be desirable to provide an improved closure that can address one or more of the above-discussed shortcomings of the prior art.

The inventors of the present invention have invented a novel structure for a closure for use with a container wherein the closure includes various advantageous features not heretofore taught or contemplated by the prior art.

BRIEF SUMMARY OF THE INVENTION

The inventors of the present invention have discovered how to provide an improved closure that would be especially suitable for a metal container, in addition to non-metal containers, wherein the closure includes novel, advantageous features not heretofore taught or contemplated by the prior art.

One aspect of the present invention includes an improved closure for a container wherein the closure is especially suitable for metal containers, but may be used with non-metallic containers. One form of such an improved closure of the present invention can better accommodate some manufacturing tolerances in a container from a given manufacturer, manufacturing variances among different container manufacturers, and/or other irregularities in the size and shape of a container opening.

An inventive article of the present invention may include just the closure alone, or the closure and container of a substance together in combination.

In one form, the invention includes an improved closure for a container, the container having at least an opening to the interior of the container and a laterally outwardly projecting flange. The closure includes a base for being installed on the container at the container opening. The base has an access passage therethrough for permitting access to the container interior. The closure includes a closing element operable on the base between (i) a closed position for occluding the access passage and (ii) an open position for permitting communication with the access passage. The base further includes a skirt for attaching the closure to the container, the skirt having (i) an exterior surface, (ii) an interior surface, (iii) a lower end portion for being located laterally outwardly of the container flange when the base is installed at the container opening, and (iv) an annular, flexible retention member extending laterally inwardly from a connection with the skirt lower end portion. The flexible retention member has (a) an initial, undeflected configuration, (b) a deflected configuration rotated away from the undeflected configuration about the connection with the skirt lower end portion, and (c) an arcuate distal side surface that faces toward the interior surface of the skirt when the flexible retention member is in its deflected configuration. The arcuate distal side surface is preferably located closer to the interior surface of the skirt when the flexible retention member is in its deflected configuration than when the flexible retention member is in its initial, undeflected configuration.

In another form, the invention includes an improved closure for a container, the container having at least an opening to the interior of the container and a laterally outwardly projecting flange. The closure includes a base for being installed on the container at the container opening. The base has an access passage therethrough for permitting access to the container interior. The closure includes a closing element operable on the base between (i) a closed position for occluding the access passage and (ii) an open position for permitting communication with the access passage. The base further includes has a skirt for attaching the closure to the container, the skirt having (i) an exterior surface, (ii) an interior surface, (iii) a lower end portion for being located laterally outwardly of the container flange when the base is installed at the container opening and which defines an annular, lower end surface, and (iv) an annular, flexible retention member extending laterally inwardly from the skirt lower end portion so as to define a connection therebetween. The flexible retention member has (a) an initial, undeflected configuration, (b) a deflected configuration rotated away from the undeflected configuration about the connection, and (c) a proximal end surface located at the connection and defining a shoulder with the lower end surface when the flexible retention member is in its undeflected configuration.

In still another form, the invention includes an improved closure for a container, the container having at least an opening to the interior of the container and a laterally outwardly projecting flange. The closure includes a base for being installed on the container at the container opening. The base has an access passage therethrough for permitting access to the container interior. The closure includes a closing element operable on the base between a closed position for occluding the access passage and an open position for permitting communication with the access passage. The base further includes has a skirt for attaching the closure to the container, the skirt having (i) an exterior surface, (ii) an interior surface, (iii) a lower end portion for being located laterally outwardly of the container flange when the base is installed at the container opening, and (iv) an annular, flexible retention member extending laterally inwardly from the skirt lower end portion so as to define a connection therebetween. The flexible retention member has (a) an initial, undeflected configuration, (b) a deflected configuration rotated away from the undeflected configuration about the connection, and the flexible retention member is movable between its initial, undeflected configuration to its deflected configuration when subjected to an axial force of between about 100 Newtons and about 150 Newtons.

In yet another aspect of the present invention, the flexible retention member extends a first axial distance from the lower end surface of the skirt, and that first axial distance is between about 15 and about 20 times greater than a second axial distance defined by and along the proximal end surface of the flexible retention member. Preferably, the proximal end surface of the flexible retention member is normal to (i.e., perpendicular to) the lower end surface of the skirt when the flexible retention member is in its initial, undeflected configuration (when viewed in a vertical cross-sectional plane taken through the vertical axis).

In still another aspect of the present invention, the connection between the flexible retention member and the skirt lower end portion extends a third axial distance from the lower end surface of the skirt, wherein the third axial distance is between about 2 and about 3 times greater than the second axial distance along the proximal end surface of the flexible retention member.

In one form of the present invention the flexible retention member includes a substantially flat distal end surface oriented a first angle of between about 25 and about 35 degrees, relative to a horizontal plane that is normal to the central vertical axis of the closure, when the flexible retention member is oriented in its undeflected configuration.

In another form of the invention, the flexible retention member has a maximum thickness at its distal end and a minimum thickness at the connection with the skirt lower end portion, the flexible retention member being tapered between its distal end toward the connection with the skirt lower end portion. Preferably, the maximum thickness is between about 1.3 and about 4 times greater than the minimum thickness.

In an alternative configuration of the inventive closure, the flexible retention member has a substantially uniform thickness between its distal end and the connection with the skirt lower end portion.

In still another form of the present invention, the flexible retention member, in its undeflected condition, extends radially and axially inwardly from the skirt lower end portion at an angle of between about 25 degrees and about 35 degrees relative to a vertical axis of the closure.

According to another form of the invention, the flexible retention member includes a flat, distal side surface that faces the container when the flexible retention member is in its deflected configuration.

According to still another form of the invention, the closure is unitarily molded from polypropylene or polyethylene.

In another aspect of the invention, the closure is combined with a container of a substance in the form of a package.

In still another form of the invention, the interior surface of the closure skirt includes at least one frustoconical reinforcement portion confronting the flexible retention member in its deflected configuration.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 6 shows the flexible retention member of the closure in an as-molded, undeflected position prior to assembly with a container;

FIG. 7 shows the flexible retention member of the closure moved into its deflected position after assembly with a container (the container not being illustrated);

FIG. 8 shows the flexible retention member of the closure oriented in its deflected position after assembly with the container;

FIG. 14 shows the flexible retention member of the closure in an as-molded, undeflected position prior to assembly with a container; FIG. 15 shows the flexible retention member of the closure in a deflected position after assembly with the container (the container not being illustrated).

DESCRIPTION OF THE PREFERRED EMBODIMENTS

While this invention is susceptible of embodiment in many different forms, this specification and the accompanying drawings disclose only specific forms as examples of the invention. The invention is not intended to be limited to the embodiments so described, however.

Figure 1:
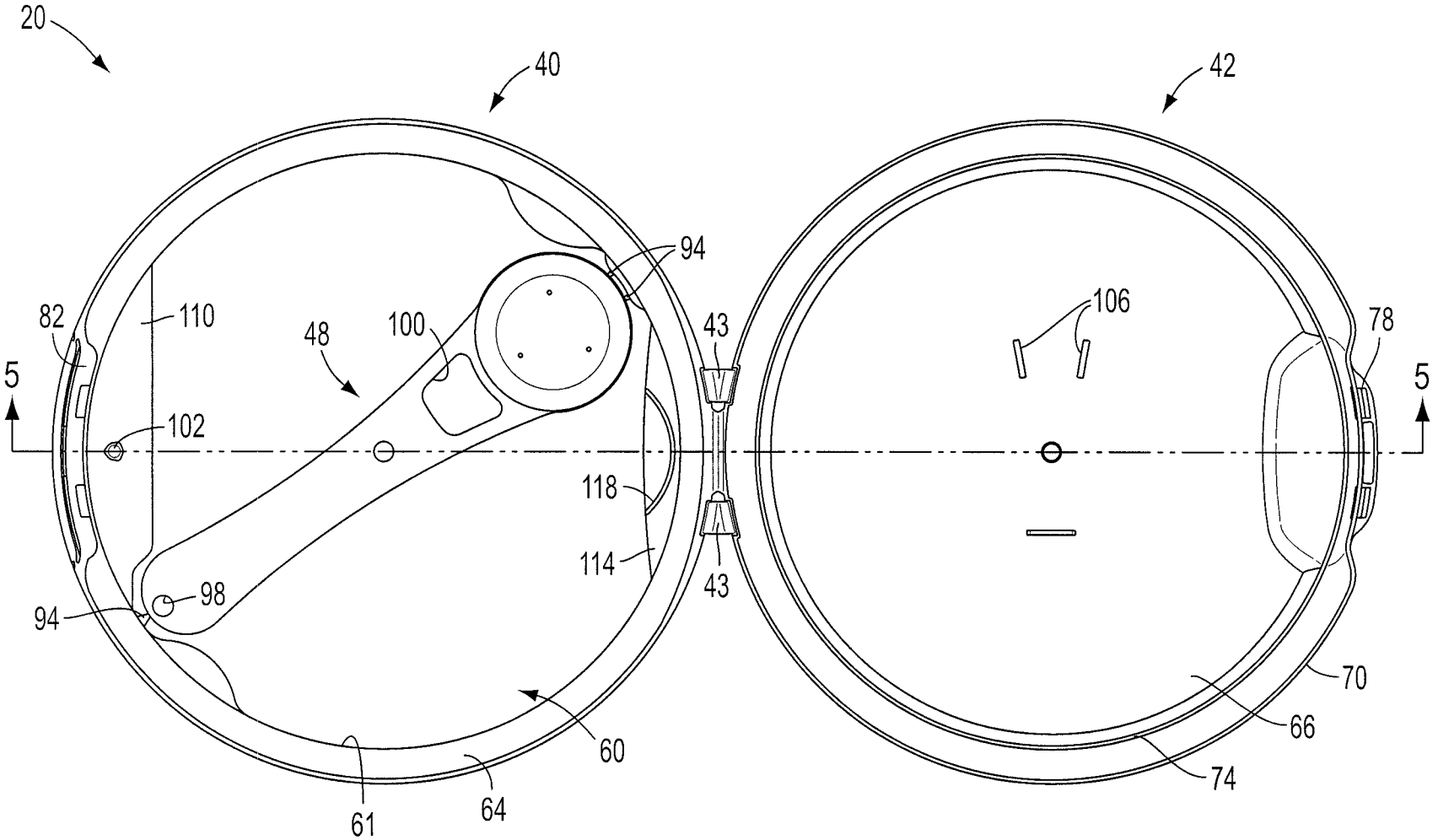
FIG. 1 is a top plan view of a first embodiment of a closure of the present invention shown in an as-molded, open condition prior to installation on a container (not illustrated in FIG. 1) in which a product may be stored—the closure, container, and product therein together constituting a "package"

For ease of description, many figures illustrating the invention show embodiments of a closure in the typical orientation that the closure would have when located at the opening of a container, the container in the form of an upright generally-cylindrical metal or composite can or bottle, and terms such as "inward", "outward", "upper", "lower", "axial", "radial", "lateral", etc., are used with reference to this orientation. The term "axially inward" is to be understood as in the direction along a central, vertical axis of the closure (axis "A" in FIGS. 3 and 4), toward the interior of the container (the container interior, which is not shown in FIGS. 3 and 4, would extend below the closure in FIGS. 3 and 4). For example, the view plane 5-5 in FIG. 1 is a vertical plane extending through the central, vertical axis of the closure. The term "axially outward" is to be understood as in the direction along the closure central, vertical axis "A" (FIGS. 3 and 4), away from the interior of the container. The term "radially inward" is to be understood as in the radial direction toward the central, vertical axis "A" of the closure. The term "radially outward" is to be understood as in the radial direction away from the central, vertical axis "A" of the closure. The term "laterally inward" is to be understood as in a direction toward the central, vertical axis "A" of the closure, in a horizontal plane that is normal to the central, vertical axis "A" of the closure. The term "laterally outward" is to be understood as in a direction away from the central, vertical axis "A" of the closure, in a horizontal plane that is normal to the central, vertical axis of the closure.

It will be understood, however, that the closures of this invention may be manufactured, stored, transported, used, and sold in an orientation other than the orientation described and illustrated.

The closures of this invention are suitable for use with a variety of conventional or special containers having various designs, the details of which, although not illustrated or described, would be apparent to those having skill in the art and an understanding of such containers. With respect to the illustrated embodiments of the closures described herein, the container, per se, forms no part of, and therefore is not intended to limit, the broadest aspects of the present invention. It will also be understood by those of ordinary skill that novel and non-obvious inventive aspects can be embodied in the described exemplary closures alone.

A first embodiment of a closure of the present invention is illustrated in FIGS. 1-8 where it is designated generally therein by reference number 20. This first embodiment of the closure 20 is initially provided as a separately manufactured article for being mounted to the top of a container 22 (partially illustrated in FIG. 8).

The container 22 has a mouth or opening 23 (FIG. 8) which provides access to the container interior where the contents, such as a product, may be contained. The product may be, for example, infant formula, mayonnaise, nuts, candies, jelly, margarine, paste, pickles, olives, etc., which can be stirred and/or removed from a container with a utensil, such as a scoop, spoon, ladle, fork, spear, etc. The product may also be a more highly fluent material that can be poured, as well as removed with a utensil, such as ground coffee, sugar, or other material, such as liquids, powders, slurries, etc. Such materials may be sold, for example, as a food product, a personal care product, an industrial or household product, or other substance (e.g., for internal or external use by humans or animals, or for use in activities involving medicine, manufacturing, commercial or household maintenance, construction, agriculture, etc.).

Figure 8:
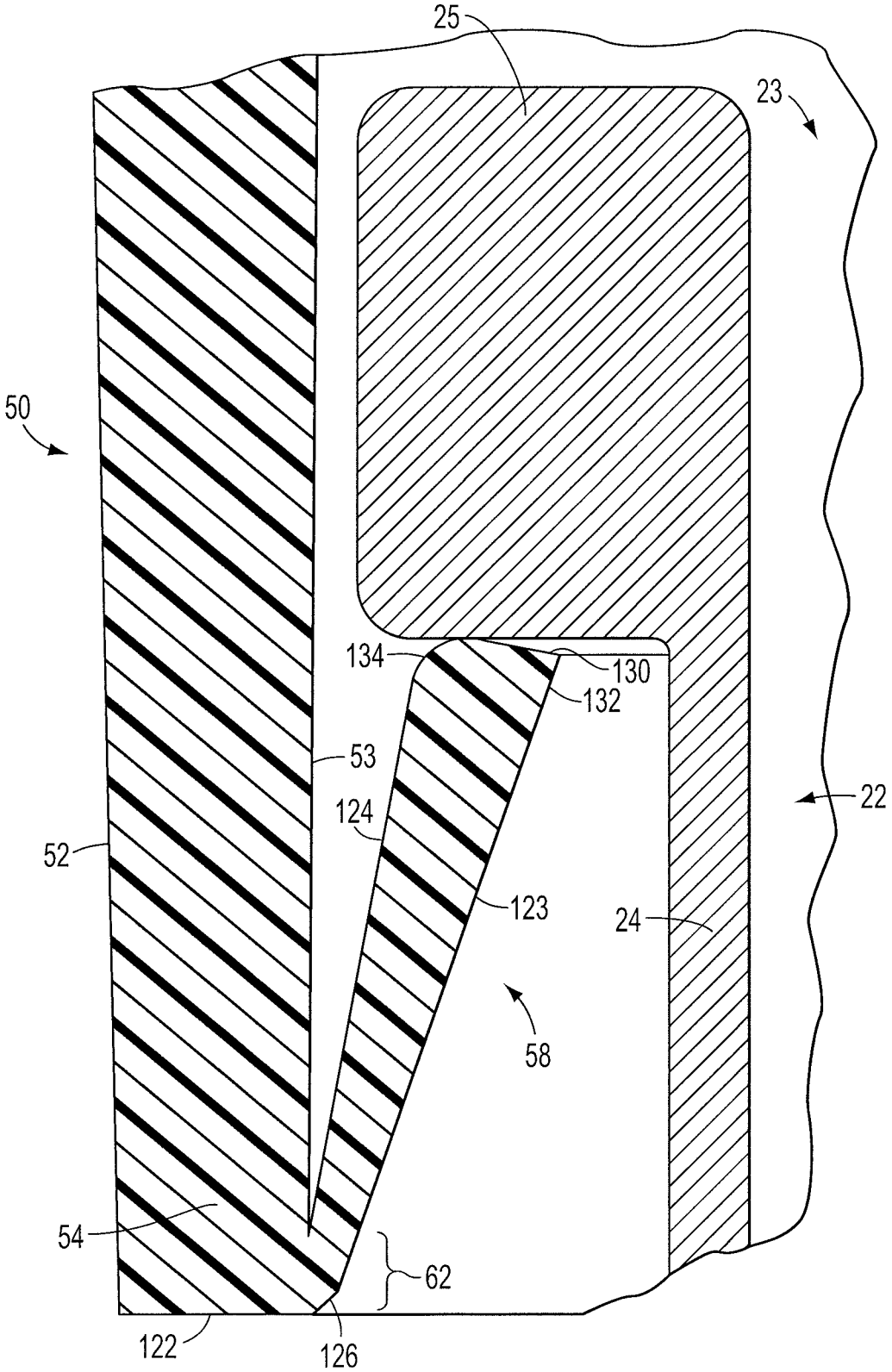
FIG. 8 is a fragmentary, greatly enlarged view of the circled portion of the closure designated as "FIG. 8" in FIG. 7 assembled with a portion of a container.
Figure 9:
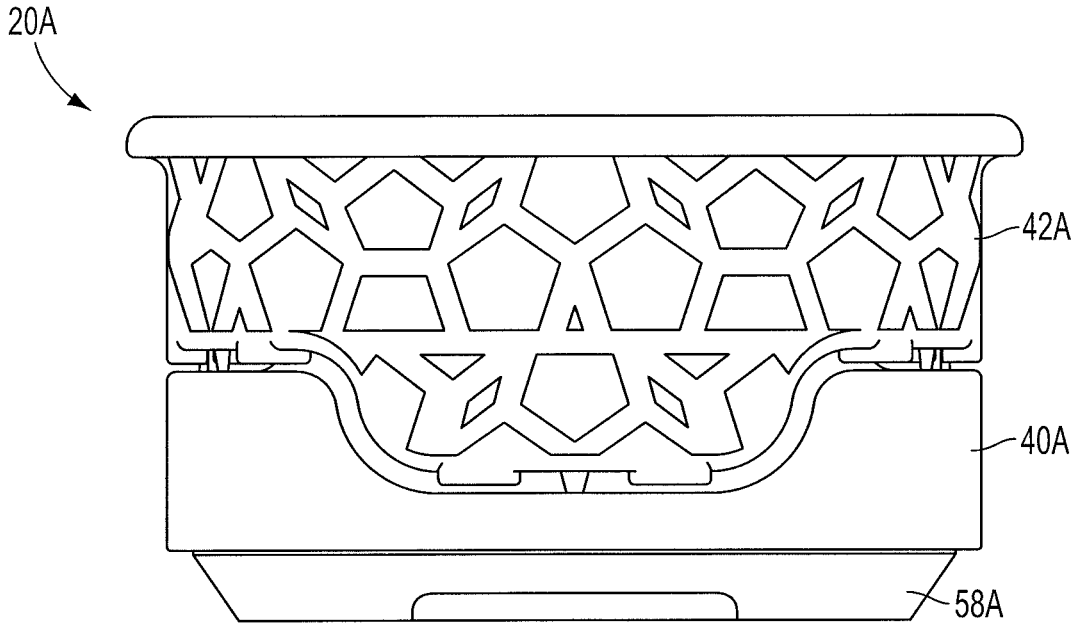
FIG. 9 is a front elevation view of a second embodiment of a closure of the present invention shown in an initial, closed condition prior to installation on a container (not illustrated in FIG. 9)
Figure 10:
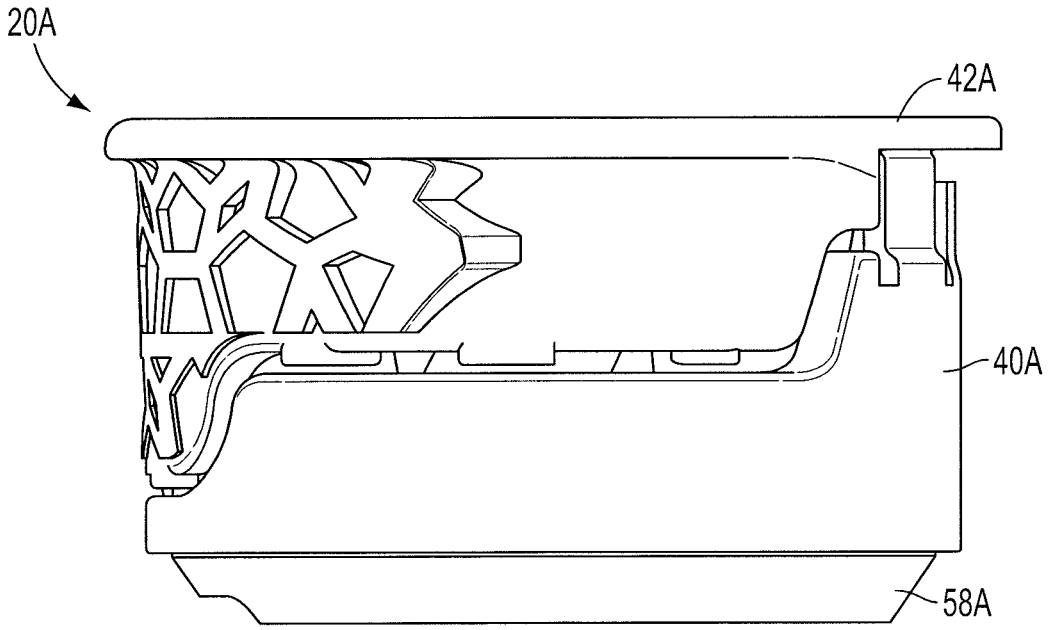
FIG. 10 is a right side elevation view of the closure shown in FIG. 9.
Figure 11:
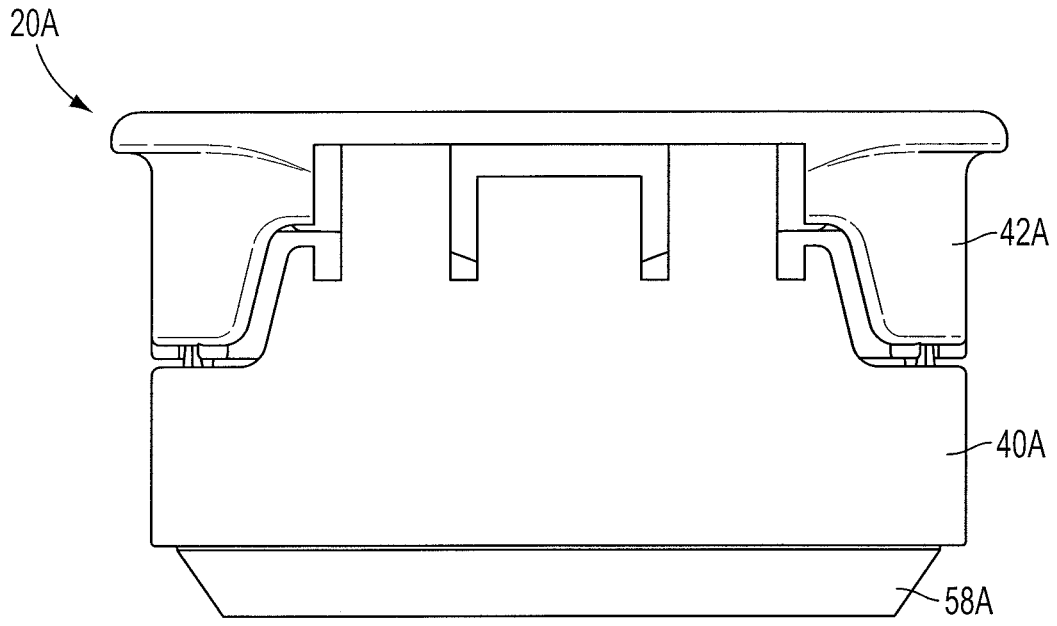
FIG. 11 is a rear elevation view of the closure shown in FIG. 9.
Figure 12:
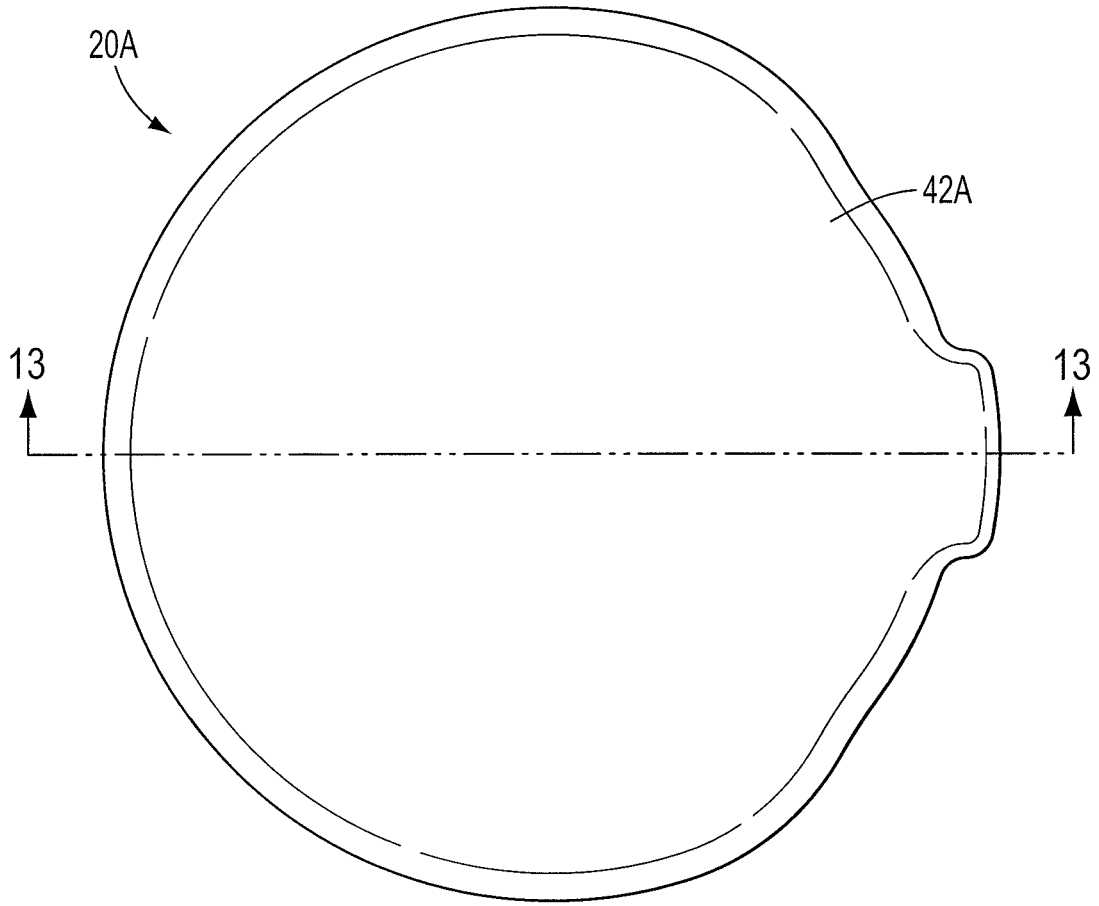
FIG. 12 is a top plan view of the closure shown in FIG. 9.
Figure 13:
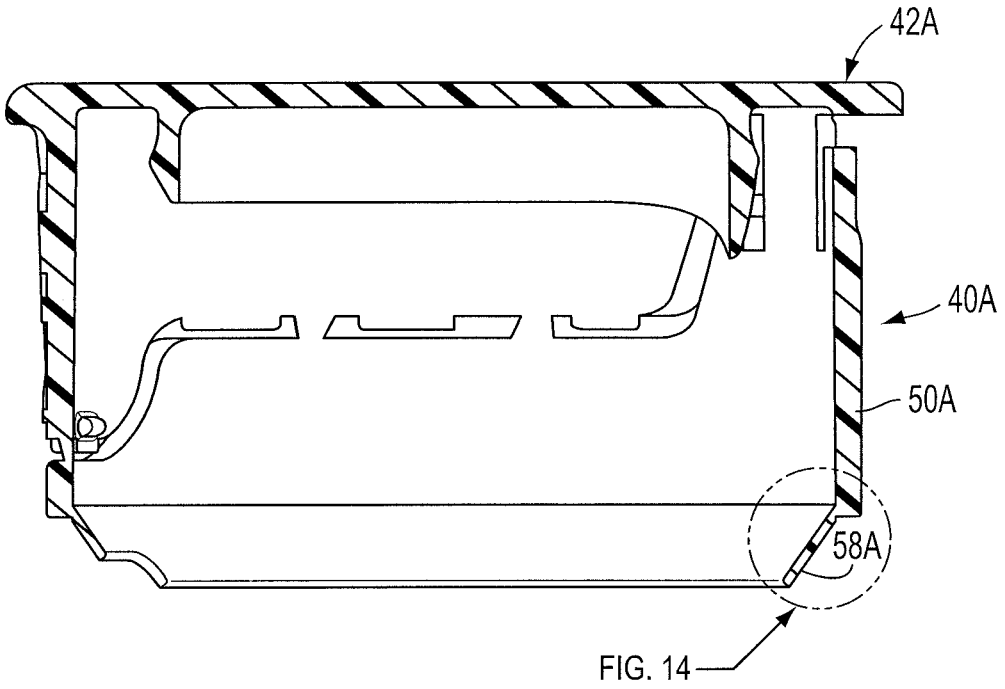
FIG. 13 is a cross-sectional, side elevation view of the closure taken along the plane 13-13 in FIG. 12.

With reference to FIG. 8, the particular illustrated container 20 includes a substantially cylindrical main body or wall portion 24 and an upper end portion or flange 25 that extends or projects laterally outwardly of (beyond) the wall portion 24. The flange 25 is illustrated as an annular portion of the container 22 that is thicker than the wall portion 24. If desired, the upper end portion of the container 22 may have other suitable shapes that define the container mouth 23 and that has a cross-sectional configuration with which the closure 20 is adapted to engage. The wall portion 25 may also have another cross-sectional configuration or shape that differs from the cross-sectional configuration or shape of the container mouth 23.

The closure 20 is especially suitable for installation with a container 22 that is metal, as is illustrated. However, for some applications, the closure 20 could be installed upon a container 22 that is plastic or a composite (e.g., plastic and metal, paperboard and metal, etc.). The container 22 may be a squeezable container having a flexible, resilient wall or walls which can be grasped by the user and compressed somewhat (i.e., temporarily, elastically deformed). The illustrated embodiment of the closure 20 is especially suitable for use with a container 22 having a cylindrical wall that is sufficiently rigid and not intended to be temporarily squeezed inwardly by the user.

The inventors have found significant variations in seam diameters or flanges (such as flange 25) at the openings of containers: (i) from a given container manufacturer; and (2) from different container manufacturers. For example, the inventors have found an average seam diameter variance of about 0.8 mm between different manufacturers for a nominal 99 mm seam diameter of the container. As another example, the inventors have found an average seam diameter variance of about 1.7 mm between different manufacturers for a nominal 127 mm seam diameter of the container. Such variances can render standard snap-fit type closures inoperable (either fitting too loosely or too tightly) when assembled at and around the container opening. The inventors have found that such variances can greatly increase the installation force required to assemble the conventional closures with containers.

The inventive closures disclosed herein, and described in detail below, can, in comparison with conventional closures, have one or more of the following advantages: greater accommodation of container seam diameter variations from a given container manufacturer and/or from different manufacturers of containers of a nominal size; accommodation of a reduction of installation force; accommodation of a simplification of the installation process and/or machinery for assembling the closure with the container; providing greater package integrity; providing more effective inhibition of ingress of pests into the container; and providing more effective centering of the closure when assembling it upon the container.

Figure 3:
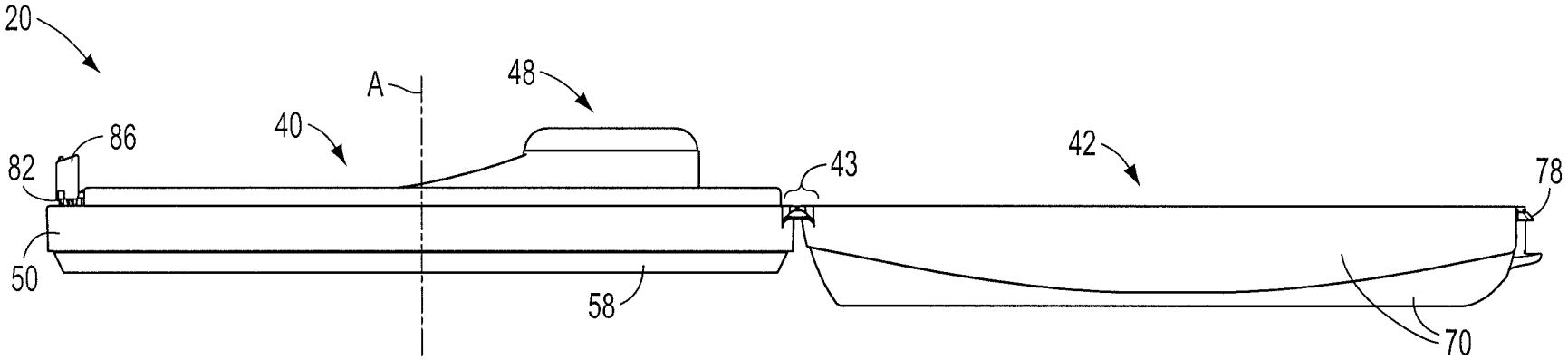
FIG. 3 is a right side elevation view of the closure shown in FIG. 1.

With reference to FIGS. 1 and 3, the closure 20 comprises a body or base 40 (i.e., a base peripheral wall or other peripheral structure) and a lid 42 (i.e., closing element, top, or cover) joined to the base 40 by a hinge 43. In the first illustrated embodiment of the closure 20, the base 40, lid 42, and hinge 43 can be readily molded together as a unitary structure in an open condition from a suitable thermoplastic material, preferably polyethylene or polypropylene. Other materials may be employed instead.

Figure 2:
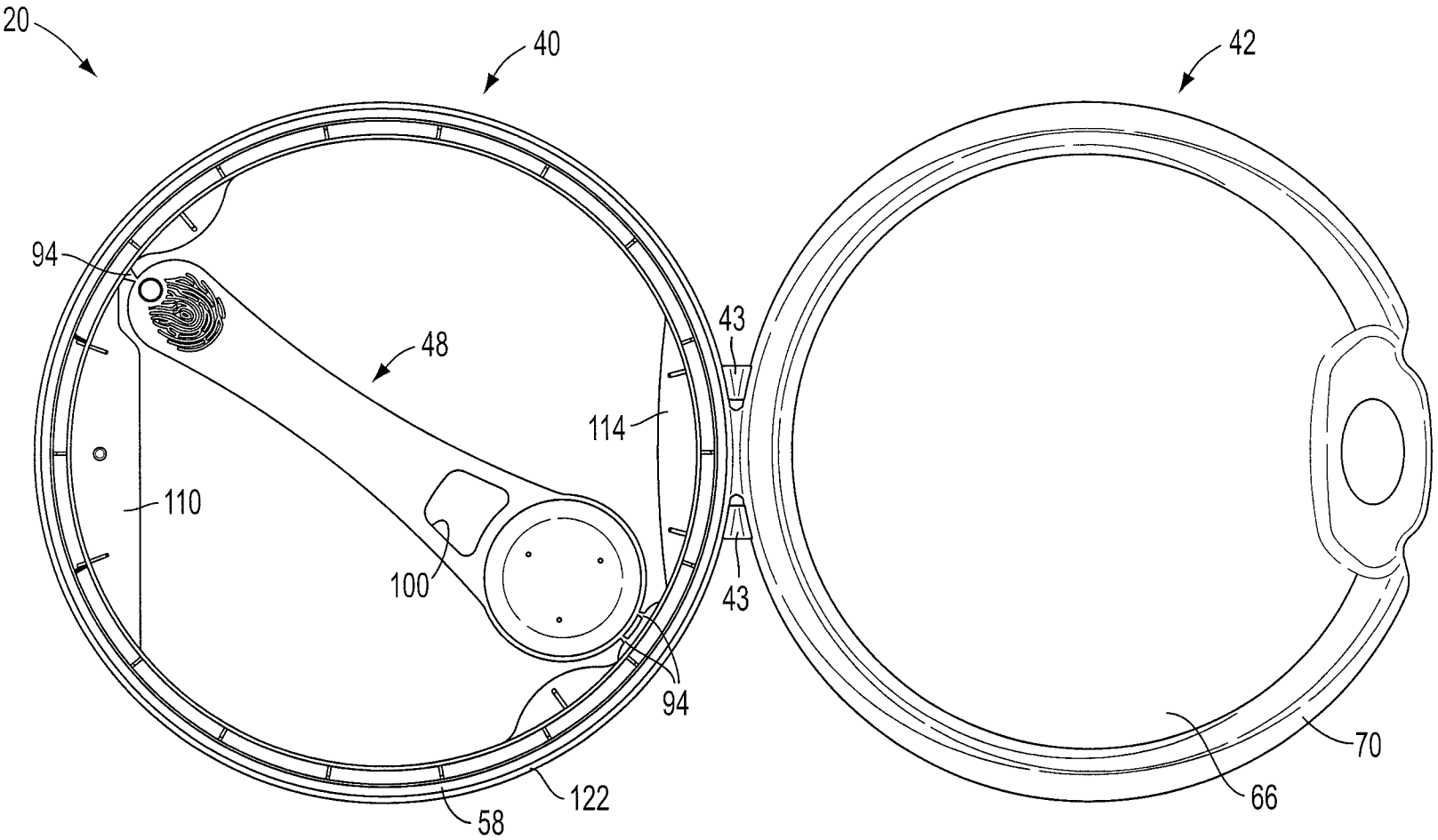
FIG. 2 is a bottom plan view of the closure shown in FIG. 1.

With reference to FIGS. 1 and 2, the closure base 40 can optionally hold a utensil in the form of a scoop 48, which may be molded unitarily with the base 40 in a manner that permits the scoop 48 to be subsequently detached or broken away from the base 40 by the user of the closure 20.

Figure 7:
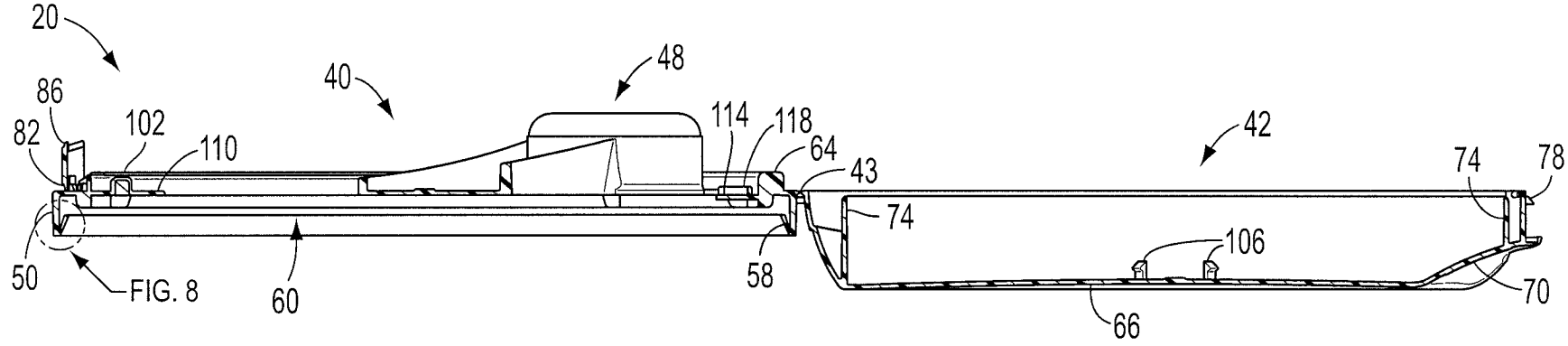
FIG. 7 is a cross-sectional, side elevation view of the closure similar to FIG. 5, however

In the first embodiment illustrated in FIGS. 1-8, the closure 20 is initially molded as a separate article that is subsequently attached to the container 22 after the container 22 has been filled with a product. With reference to FIGS. 6 and 8, the closure base 40 has a depending, peripheral, outer skirt 50 defining an exterior surface 52 and an interior surface 53, and a lower end portion 54 connected to an annular, flexible retention member 58. The flexible retention member 58 is movable (e.g., bendable, deformable (plastically or elastically), rotatable, etc.) about a connection 62 with the lower end portion of the skirt 54 from (i) an initial, undeflected configuration (as illustrated in FIG. 3-6) prior to installation upon the container 22 to (ii) a deflected configuration rotated away from the initial, undeflected configuration (as illustrated in FIGS. 7 and 8). In its deflected configuration, the flexible retention member 58 confronts the flange 25 and the wall portion 24 of the container 22 (portions of the container 22 being visible in FIG. 8 only) to secure the closure base 40 around the mouth 23 of the container 22, as will be discussed in greater detail hereinafter. The inventors have found that the flexible retention member 58 is an improvement over other retaining features of the prior art, such those on the closures illustrated and described in International Publication Number WO 2016/022744 A1, which is incorporated by reference in its entirety herein.

The closure base 40 may also include additional special or conventional seal features to provide an enhanced leak-tight seal between the closure base 40 and the container 22. The illustrated base 40 does not employ such an enhanced seal feature.

Figure 5:
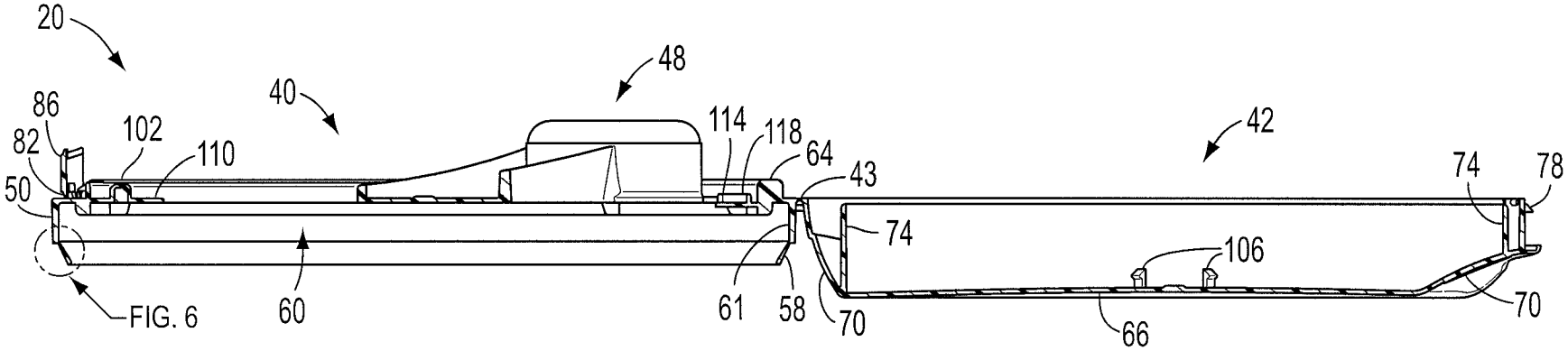
FIG. 5 is a cross-sectional, side elevation view of the closure taken along the plane 5-5 in FIG. 1.
Figure 6:
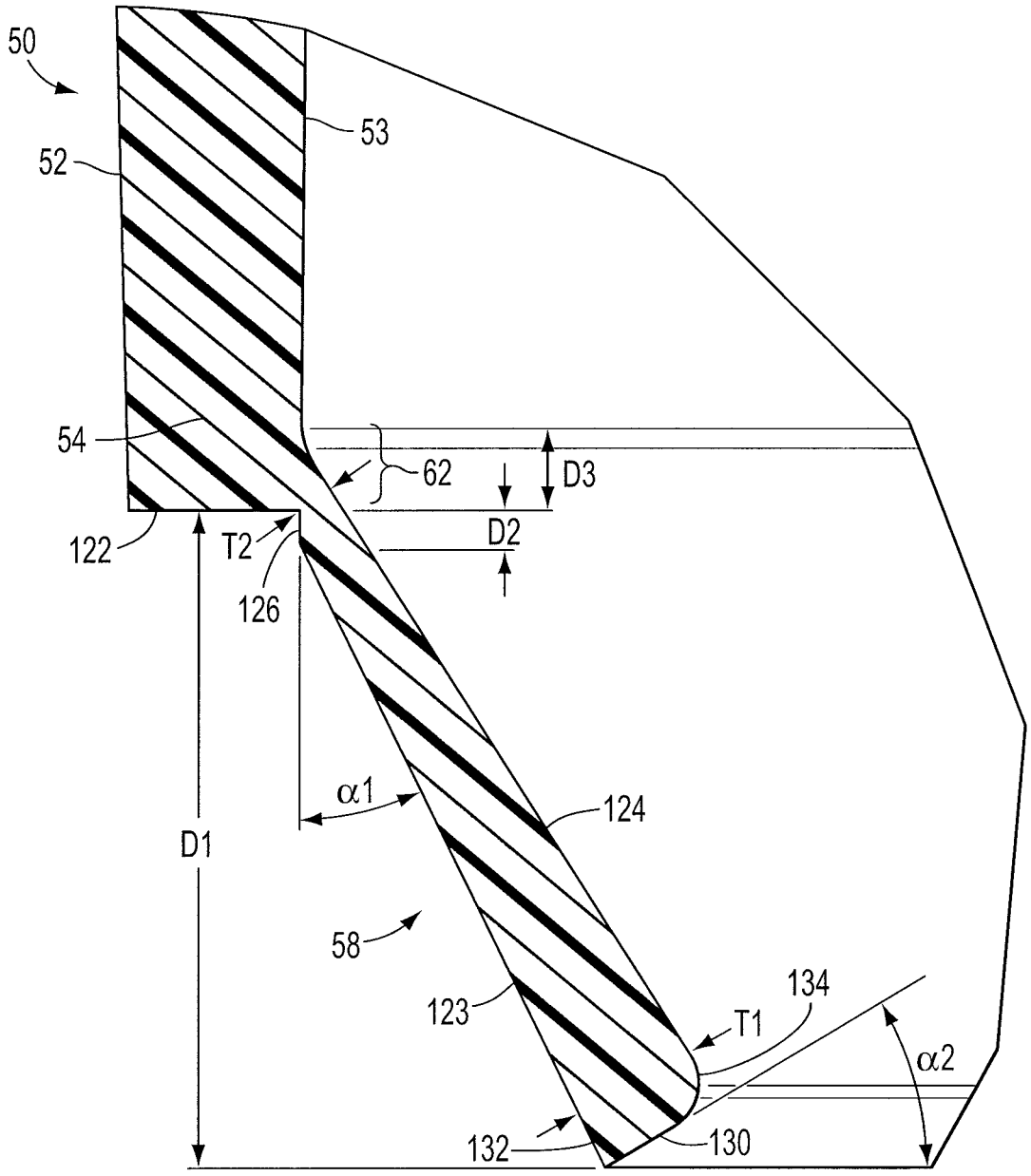
FIG. 6 is a fragmentary, greatly enlarged view of the circled portion of the closure designated as "FIG. 6" in FIG. 5.

Referring now to FIGS. 1 and 5, the closure base 40 has an opening or access passage 60 that is defined by an internal surface 61 of the base 40. An upper end or rim 64 of the closure 20 surrounds the access passage 60. The access passage 60 can be occluded or covered by the lid 42 when the lid 42 is rotated from its open position (FIG. 1) to a closed position (not illustrated) over the base 40. The lid 42 includes a top deck or cover 66 surrounded by a depending outer wall 70. An inner plug seal 74 projects from the underside of the deck 66 to sealingly engage the inside of the closure base rim 64 when the lid 42 is closed.

Still referring to FIGS. 1 and 5, the closure hinge 43 is molded unitarily together with the closure lid 42 and closure base 40 near the top of the base skirt 50 (FIG. 5) so as to accommodate movement of the lid 43 between the open position exposing the base access passage 60, and the closed position occluding the body access passage 60. The hinge 43 may be of any suitable conventional or special design. For example, the hinge 43 illustrated in the Figures may be of a conventional snap-action type such as described in the U.S. Pat. No. 5,356,017 or 5,642,824, which are incorporated herein in their entirety. The hinge 43 could also be a non-snap-action type, including a strap or tether. The hinge 43 could be omitted altogether for some applications, such as when the lid 42 is removably screw threaded or snap fit onto the closure base 40.

Figure 4:
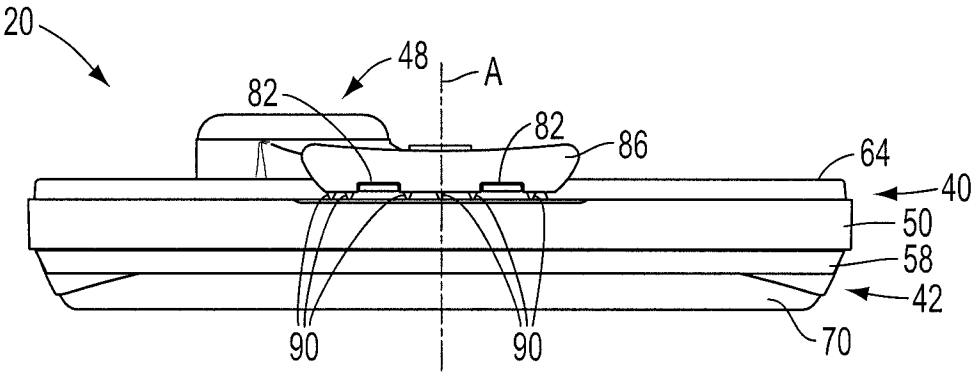
FIG. 4 is a front elevation view of the closure shown in FIG. 1.

Referring now to FIGS. 3 and 4, a pair of latch projections 78 (visible in FIG. 3) extend laterally outwardly from a front portion of the lid 42. Each one of the latch projections 78 is received within one latch aperture 82 located on a front portion or tab 86 on the closure base 40 to secure the lid 43 to the base 40. The tab 86 is connected to the base 40 by a plurality of triangular-shaped frangible bridges or connections 90 (FIG. 4). The tab 86 may be separated from the remainder of the base 40 when the user exerts a sufficient pulling force on the tab 86 to break the frangible bridges 90, providing evidence of tampering. Other conventional or special latch designs could be used instead. For example, the latching mechanism may be reversed whereby the latch projections 78 may be located on the closure base 40, while the latch apertures 82 may be located on the closure lid 42. Furthermore, the tab 86 need not be completely removable by a user, or may be omitted altogether, in some applications.

With reference to FIG. 1, the scoop 48 is initially molded unitarily with the closure base 40 and is connected to the closure base 40 with short, frangible bridges or connections 94 which can be broken by a user to manually separate scoop 48 from closure base 40. The scoop 48 includes an aperture 98 in its handle portion, which functions, after the user has separated the scoop 48 from the closure base 40, to receive a cylindrical projection 102 located on the closure base 40 to frictionally retain the handle portion of the scoop 48 in a first storage configuration atop the base 40. The scoop 48 further includes a larger aperture 100 located in its handle portion to accommodate projections 106 located on the underside of the lid 42 to retain the scoop 48 in a second storage configuration beneath the lid 42. One or both of the projections 106 are configured for undergoing temporary elastic deformation to permit deflection thereof to accommodate insertion of the utensil handle portion between the projections 106 so that the projections 106 extend through the larger aperture 100 to resiliently engage and retain the handle portion of the scoop 48. When a sufficient force is applied by a user to pull out the scoop 48, the scoop 48 can be released from the lid 43 by the projections 106 temporarily, elastically deforming or deflecting outwardly to permit the projections 106 to be withdrawn through the larger aperture 100 of the scoop 48.

While the first illustrated embodiment of the closure 20 includes a utensil in the form of a scoop 48, it will be understood that other types of utensils could readily be implemented in accordance with other embodiments of the invention, such as a spoon, ladle, knife, fork, spear, or other structure, particularly those having an elongated handle. The utensil may not be included in the closure 20 in still other applications, such as when the closure 20 is utilized on a container of a beverage.

Still referring to FIG. 1, the base 40 includes a leveling flange 110 extending laterally from the base rim 64 for leveling an amount of product that has been removed from the container 22 with the scoop 48. The base 40 includes a second flange 114, located opposite the leveling flange 110, which includes a vertically-extending arcuate wall 118 for centering the scoop 48 when stored on the closure base 40 (e.g., with the base projection 102 received within aperture 98 of the scoop handle).

In some applications, it may be desirable to provide a foil or composite gas-blocking or inhibiting liner (not illustrated) either across the mouth 23 of the container 22 or across the interior of the access passage 60 of the base 40. In such applications, the scoop 48 may be connected to the closure base 40 at a location that is further axially outwardly relative to container mouth 23 so as to create additional clearance between the utensil 48 and such a seal. An exemplary foil or liner is described in the U.S. Pat. No. 7,721,901, which is incorporated herein in its entirety.

FIG. 6 illustrates the detailed structures of the lower end portion 54 of the closure body skirt 50 and the flexible retention member 58 located in its initial, undeflected configuration (simply referred to as the "undeflected configuration" hereinafter). FIG. 6 illustrates the flexible retention member 58 in one preferred, as-molded position when unitarily molded together with the base 40, the hinge 43, and the lid 42. It will be understood that the flexible retention member 58 could be molded or otherwise formed in different orientations than that illustrated.

Still referring to FIG. 6, the closure skirt lower end portion 54 includes a substantially flat lower end surface 122 that has a ring-like or annular shape (as can be seen in FIG. 2). The flexible retention member 58 projects both radially and axially inwardly from its connection 62 with the lower end portion 54 when the flexible retention member 58 is in its undeflected configuration. In its undeflected configuration, the flexible retention member 58 has a maximum height or distance D1, as measured from the lower end surface 122 in the axial direction, and the flexible retention member 58 is oriented an angle $\alpha 1$ relative to the vertical axis. Preferably, the angle $\alpha 1$ is between about 25 and about 35 degrees, and even more preferably the angle $\alpha 1$ is about 26 degrees.

Referring to FIG. 6, the flexible retention member 58 includes a first side surface 123 and an oppositely-facing second side surface 124. The first side surface 123 is initially located laterally or radially outward of the second side surface 124 with the flexible retention member 58 in its undeflected configuration. The flexible retention member 58 is tapered, having a maximum thickness T1 between the first and second side surfaces 123,124 at or near its cantilevered, distal end and a minimum thickness T2 between the first and second side surfaces 123,124 at or near the connection 62 with the lower end portion 54. Preferably, the maximum thickness T1 is between about 1.3 and about 4 times greater than the minimum thickness T2.

Again, referring to FIG. 6, the flexible retention member 58 includes a cylindrical, proximal end surface 126 that is substantially perpendicular to the lower end surface 122 to form a shoulder, when the flexible retention member 58 is in its undeflected configuration. The proximal end surface 126 has a maximum height or distance D2, as measured from the lower end surface 122 in the axial direction. The shoulder serves to assist in the flexibility of the retention member 58 as it moves between the undeflected and deflected configurations, and the ratio of the distance D1 to the distance D2 is preferably between about 15 and about 20.

Referring now to the distal, cantilevered portion of the flexible retention member 58 as best illustrated in FIG. 6, the retention member 58 includes a substantially flat, distal end surface 130, a substantially flat, distal side surface 132 located on the first side surface 123, and a convex or arcuate distal side surface 134 located on the first side surface 124. The arcuate distal side surface 134 serves lower the force required by a user to remove the closure 20 from an installed position atop a container 22, such as for accessing an removing a foil liner sealed across the opening 23 of the container 22. In other words, the arcuate distal side surface 134 can permit the flexible retention member 58 move from its deflected configuration back into its undeflected configuration.

The flat distal end surface 130 (FIG. 6) is oriented an angle $\alpha 2$ relative to the horizontal axis when the flexible retention member 58 is in its undeflected configuration. Preferably, the angle $\alpha 2$ is between about 25 and about 35 degrees.

Referring now to the proximal portion of the flexible retention member 58, as best illustrated in FIG. 6, the retention member 58 includes a slight internal radius at the connection 62 of the retention member 58 with the lower end portion 54 of the skirt 50. The connection 62 has a maximum height or distance D3, as measured from the lower end surface 122 in the axial direction. The ratio of the distance D3 to the distance D2 (along the proximal end surface 126) is preferably between about 2 and 3.

Referring now to FIG. 8, the flexible retention member 58 is illustrated in its deflected configuration after installation of the closure 20 with the container 22. In FIG. 8, interference between the distal end portion of the flexible retention member 58 and the flange 25 of the container 22 has forced or flexed (bent, rotated, deformed) the retention member 58 about its connection 62 with the lower end portion 54 of the skirt 50 during installation of the closure 20 with the container 22. In the illustrated deflected configuration, the arcuate distal side surface 134 is moved into a confronting position with the interior surface 53 of the skirt 50 while the flat distal side surface 132 is moved into a confronting position with the wall 24 of the container 22, and the distal end surface 130 is moved into a confronting position with the bottom of the flange 25 of the container 22. Furthermore, in the illustrated deflected configuration of the retention member 58, the proximal end surface 126 is rotated upwardly above the flat lower end surface 122 of the lower end portion 54 of the skirt 50.

It will be understood that FIG. 8 illustrates one deflected configuration of the flexible retention member 58 when the closure 20 is installed upon a container 22. The flexible retention member 58 could be located or rotated about the connection 62 either further toward, or further away from, the container wall 24 in the deflected configuration, depending on several factors, such as the shape and lateral width of the container flange 25, the elasticity of the material of the closure 22, and/or sizing of the closure 22. For example, the flexible retention member 58 might abut and touch the wall 24 in its deflected configuration.

The inventors have found that a closure having a flexible retention member 58 as described herein may provide advantageous retention and sealing properties while substantially reducing the required installation force necessary to assemble the closure together with a container having a standard or special opening diameter or seam diameter. For example, the force required to install a conventional snap-fit (i.e., snap bead) closure on a metal container with a 127 mm seam diameter has been found to be between about 200-400 Newtons, with the force applied normally to top surface of the closed lid of the closure and pushing axially downward atop the container flange 25 around the opening 23. In contrast, the closures having a flexible retention member 58 as described herein can be applied to the same metal container with a 127 mm seam diameter using a significantly lower installation force of between about 100 and about 150 Newtons.

The inventors have discovered that a closure having a flexible retention member 58 as described herein is especially suitable for use with a variety of containers that have a wide variability of tolerances with respect to their flange and opening diameters. For example, it has been found that metal containers having a given nominal opening or flange diameter vary greatly depending on the manufacturer or supplier. The variance renders traditional snap-fit type closures inapplicable for use with a wide variety of containers manufactured by different suppliers and necessitates customized closures for each container supplier. In other words, the conventional snap-fit closures typically cannot be universally used on a large number of stock containers on the market. The closures having a flexible retention member 58 as described herein are particularly useful across the whole range, or at least a larger range, of containers supplied by various manufacturers and may better accommodate such dimensional variances between manufacturers.

The inventors have discovered that a closure having a flexible retention member 58 as described herein is especially suitable to prevent, or at least minimize, the likelihood of insect infiltration. Furthermore, the flexible retention member 58 may prevent tampering, or at least exhibit tampering (such as by stress whitening of the closure material), if a user attempts to forcibly remove the installed closure from a container.

The inventors have further found that a closure having a flexible retention member 58 as described herein is may provide improved centering of the closure upon the container during assembly when compared to conventional closures (such as a snap-fit type closure).

FIGS. 9-14 illustrate a second embodiment of a closure 20A according to the present invention. The numbered features of the second embodiment of the closure 20A illustrated in FIGS. 9-14 are designated generally with the suffix letter "A" and are analogous to features of the first embodiment of the closure 20 that share the same number (without the suffix letter "A"). The second illustrated embodiment of the closure 20A is similar to the first illustrated embodiment of the closure 20 illustrated in FIGS. 1-8, and the second illustrated embodiment of the closure 20A includes the basic components of a base 40A having a skirt 50A portion for being located laterally around an opening in a container (such as the container 22 in FIG. 8), and a lid 42A.

Figure 14:
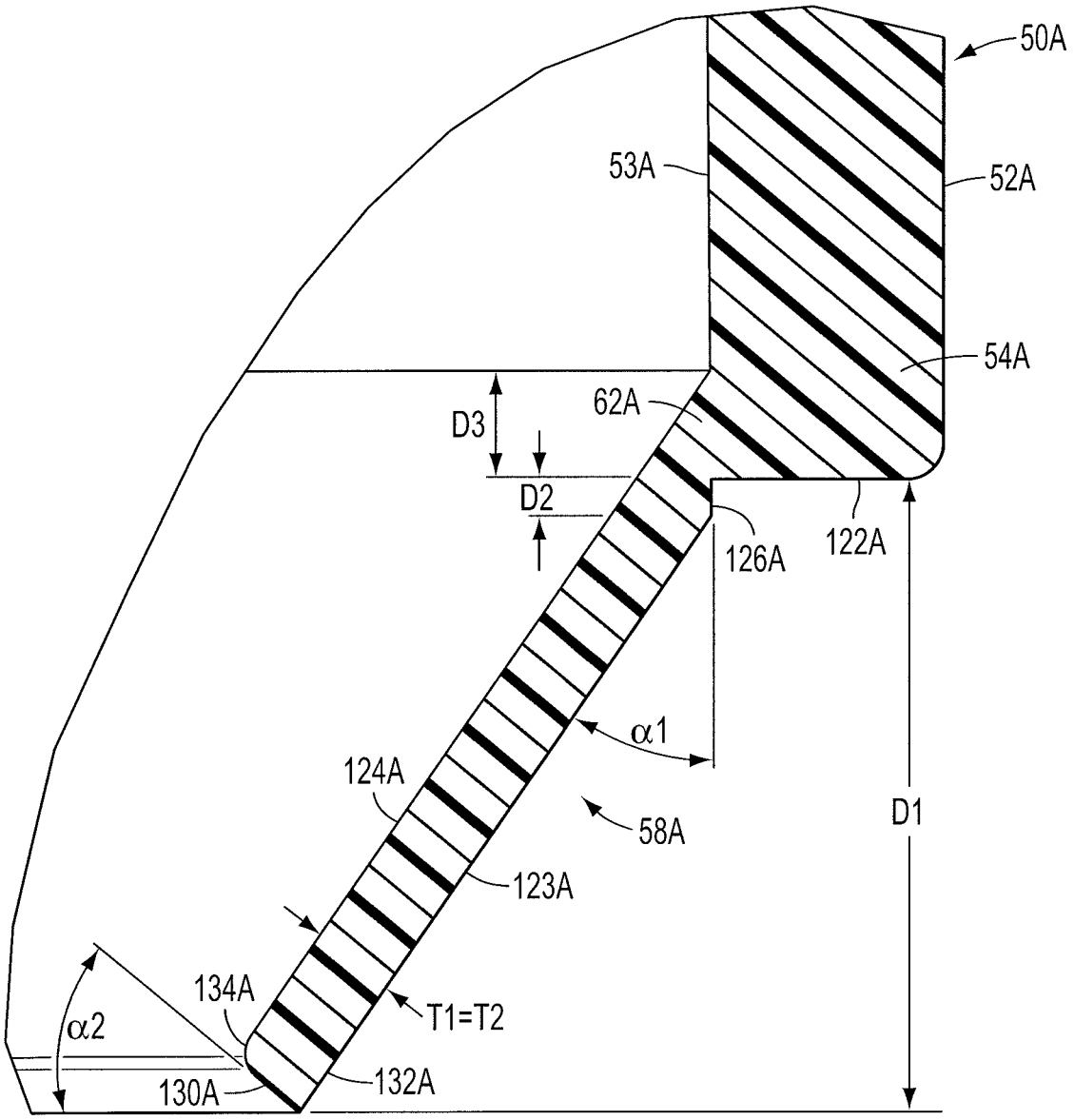
FIG. 14 is a fragmentary, greatly enlarged view of the circled portion of the closure designated as "FIG. 14" in FIG. 13.

With reference to FIG. 14, the skirt 50A also includes an exterior surface 52A, an interior surface 53A, and a lower end portion 54A connected to an annular, flexible retention member 58A. The flexible retention member 58A is movable or rotatable about its connection 62A to the lower end portion 54A.

The second embodiment of the closure 20A differs from the first illustrated embodiment of the closure 20 in that the flexible retention member 58A is substantially uniform in thickness, as measured from a first side surface 123A and a second side surface 124A, between its proximal and distal ends. The flexible retention member 58A further includes a distal end surface 130A and a flat distal side surface 132A. The thickness TI and T2, between the first and second sides surfaces 123A and 124A of the retention member 58A are equal or at least substantially equal along almost all of the length of the member 58A. Compared to the first illustrated embodiment of the closure 20, the second embodiment of the closure 20A can utilize a lesser amount of material, which results in a lower weight and reduced material costs. Further, the closure 20A can have a comparatively lower installation force when mated with a container due to the shape of the retention member 58A. Furthermore, the second embodiment of the closure 20A may be more suitable for use on a container of a substance where the user would temporarily remove the closure 20A from the container in order to access and remove a temporary seal or foil liner across the container opening, with the user subsequently reinstalling the closure 20A on the container.

Figure 15:
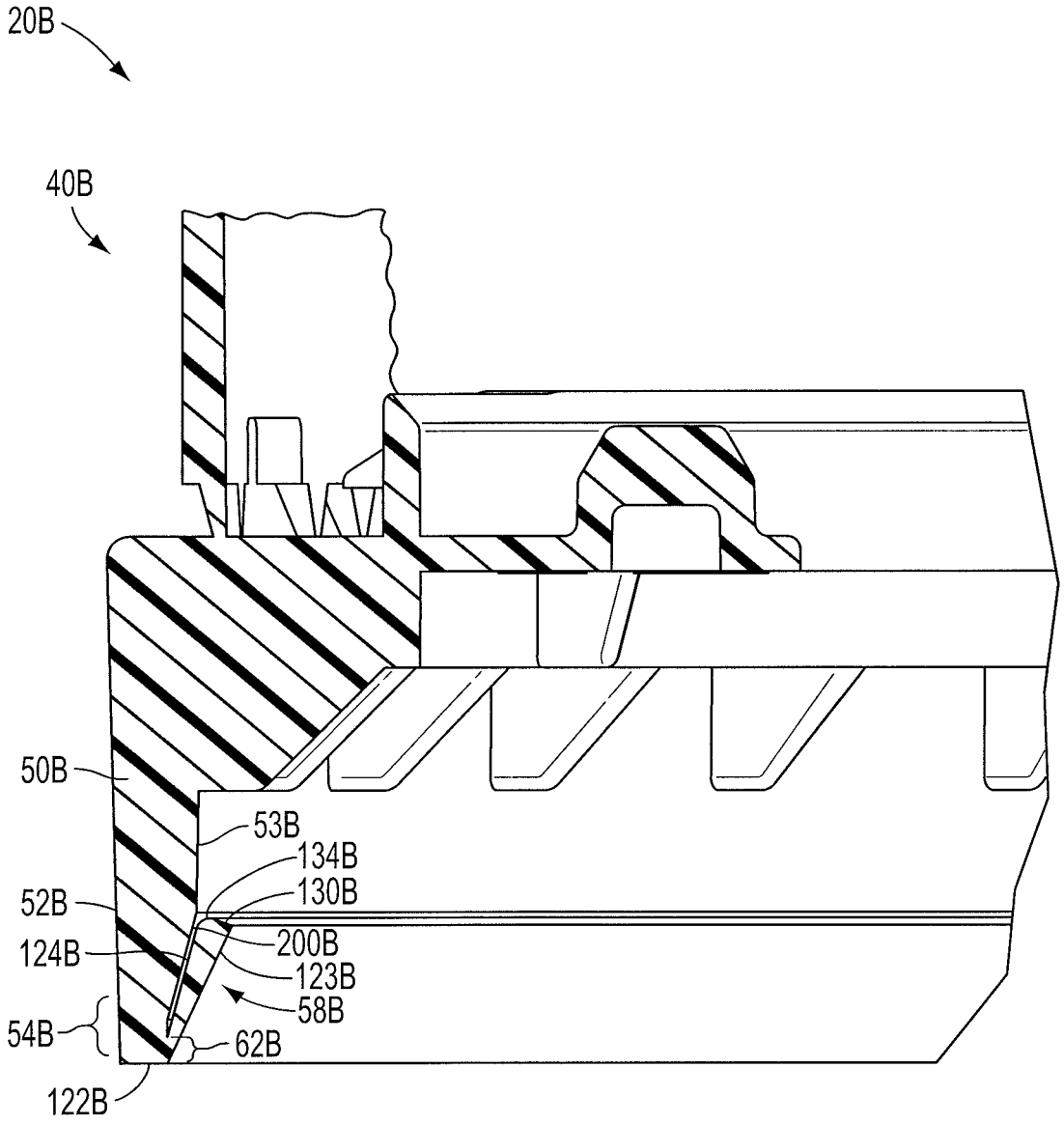
FIG. 15 is a fragmentary, greatly enlarged view of only a bottom or lower portion of a third embodiment of a closure of the present invention.

FIG. 15 illustrates a bottom portion of a third embodiment of a closure 20B according to the present invention. The numbered features of the third embodiment of the closure 20B illustrated in FIG. 15 are designated generally with the suffix letter "B" and are analogous to features of the first of the closure 20 that share the same number (without the suffix letter "B"). The third illustrated embodiment of the closure 20B is similar to the first illustrated embodiment of the closure 20 illustrated in FIGS. 1-8, and the third illustrated embodiment of the closure 20B includes the basic components of a base 40B having a skirt 50B portion for being located around an opening in a container (such as the container 22 in FIG. 8).

With reference to FIG. 15, the skirt 50B also includes an exterior surface 52B, an interior surface 53B, and a lower end portion 54B connected to an annular, flexible retention member 58B. The flexible retention member 58B is movable or rotatable about its connection 62B to the lower end portion 54B. The flexible retention member 58B includes a first side surface 123B and a second side surface 124B and a distal end surface 130B.

The third embodiment of the closure 20B differs from the first illustrated embodiment of the closure 20 in that the interior surface 53B includes a frustoconical reinforcement portion 200B for abutting, and limiting laterally outward movement of, the flexible retention member 58B when the flexible retention member 58B is located in its deflected configuration (subsequent to assembly upon a container 22). The frustoconical reinforcement portion 200B may extend around the entire circumference of the closure skirt 50B, or alternatively, it may take the form of multiple discontinuous frustoconical reinforcement portions 200B spaced apart around internal circumference of the closure skirt 50B. The frustoconical reinforcement portion or portions 200B function to help retain the closure 20B on the container by limiting or restricting the laterally outward movement of the deflected flexible retention member 58B about the connection 62B.

It will be readily apparent from the foregoing detailed description of the invention and from the illustrations thereof that numerous variations and modifications may be effected without departing from the true spirit and scope of the novel concepts or principles of this invention.

For example, it will be appreciated that one broad aspect of the invention includes a closure having a flexible retention member 58, 58A, 58B that is movable between its initial, undeflected configuration to its deflected configuration when subjected to an axially outward force of between about 100 Newtons and about 150 Newtons. That feature may be considered to be a separate feature which may provide utility separately apart from other features. Thus, it is contemplated that this one broad aspect of the invention may be claimed separately without necessarily being in combination with one or more of the other features. Alternatively, this one feature may be claimed in combination with other features disclosed herein.

Furthermore, it will be appreciated that another broad aspect of the invention includes the inventive feature of a closure having a flexible retention member 58, 58A, 58B with an arcuate distal side surface 134, 134A, 134B that faces toward the interior surface 53, 53A, 53B of the skirt 50, 50A, 50B when the flexible retention member 58, 58A, 58B is in its deflected configuration. That feature may be considered to be a separate feature which may provide utility separately apart from other features. Thus, it is contemplated that this one broad aspect of the invention may be claimed separately without necessarily being in combination with one or more of the other features. Alternatively, this one feature may be claimed in combination with other features disclosed herein.

In addition, it will be appreciated that another broad aspect of the invention includes the inventive feature of a closure having a flexible retention member 58, 58A, 58B with a proximal end surface 126, 126A located at the connection 62, 62A, 62B with the skirt lower end portion (54, 54A, 54B), wherein the proximal end surface 126, 126A and the lower end surface 122, 122A, 122B together define a shoulder when the flexible retention member 58, 58A, 58B is in its undeflected configuration. That feature may be considered to be a separate feature which may provide utility separately apart from other features. Thus, it is contemplated that this one broad aspect of the invention may be claimed separately without necessarily being in combination with one or more of the other features. Alternatively, this one feature may be claimed in combination with other features disclosed herein.

What is claimed is:

1. A closure for a container, said container having an opening to the interior of the container wherein contents may be stored and an outwardly projecting flange, said closure comprising:

(A) a base for being installed on the container at the container opening, said base having an access passage through said base for permitting access to the container interior; and (B) a closing element operable on said base between a closed position for occluding said access passage and an open position for permitting communication with said access passage, and wherein said base has a skirt for attaching said closure to the container, said skirt having (i) an exterior surface, (ii) an interior surface, (iii) a lower end portion for being located laterally outwardly of the container flange when said base is installed at the container opening, and (iv) an annular, flexible retention member extending laterally inwardly from said skirt lower end portion so as to define a connection therebetween, said flexible retention member having (a) an initial, undeflected configuration, (b) a deflected configuration rotated away from said initial, undeflected configuration about said connection, and (c) an arcuate distal side surface, when viewed in a vertical cross-section through a central axis of the closure, that faces toward said interior surface of said skirt when said flexible retention member is in said deflected configuration, and that is closer to said interior surface when said flexible retention member is in said deflected configuration than when said flexible retention member is in said initial, undeflected configuration.

2. A closure for a container, said container having an opening to the interior of the container wherein contents may be stored and an outwardly projecting flange, said closure comprising:

(A) a base for being installed on the container at the container opening, said base having an access passage through said base for permitting access to the container interior; and (B) a closing element operable on said base between a closed position for occluding said access passage and an open position for permitting communication with said access passage, and wherein said base has a skirt for attaching said closure to the container, said skirt having (i) an exterior surface, (ii) an interior surface, (iii) a lower end portion for being located laterally outwardly of the container flange when said base is installed at the container opening, said lower end portion defining an annular, lower end surface, and (iv) an annular, flexible retention member extending laterally inwardly from said lower end portion so as to define a connection therebetween, said flexible retention member having (a) an initial, undeflected configuration, (b) a deflected configuration rotated away from said initial, undeflected configuration about said connection, and (c) a proximal end surface located at said connection, said proximal end surface and said lower end surface together defining a shoulder when said flexible retention member is in said undeflected configuration, said proximal end surface of said flexible retention member is normal to said lower end surface in said undeflected configuration, when viewed in a vertical cross-sectional plane taken through a central axis of said closure.

3. A closure for a container, said container having an opening to the interior of the container wherein contents may be stored and an outwardly projecting flange, said closure comprising:

(A) a base for being installed on the container at the container opening, said base having an access passage through said base for permitting access to the container interior; and (B) a closing element operable on said base between a closed position for occluding said access passage and an open position for permitting communication with said access passage, and wherein said base has a skirt for attaching said closure to the container, said skirt having (i) an exterior surface, (ii) an interior surface, (iii) a lower end portion for being located laterally outwardly of the container flange when said base is installed at the container opening, and (iv) an annular, flexible retention member extending laterally inwardly from said lower end portion so as to define a connection therebetween, said flexible retention member having (a) an initial, undeflected configuration, and (b) a deflected configuration rotated away from said initial, undeflected configuration about said connection, and said flexible retention member being movable between said initial, undeflected configuration to said deflected configuration when subjected to an axial force of between 100 Newtons and 150 Newtons.

4. The closure in accordance with claim 2 in which (i) said flexible retention member extends a first distance from said lower end surface of said skirt, and (ii) said proximal end surface of said flexible retention extends a second distance away from said lower end surface of said skirt, when said flexible retention member is in said undeflected configuration, wherein said first distance is between 15 and 20 times greater than said second distance.

5. The closure in accordance with claim 2 in which (i) said connection between said flexible retention member and said skirt lower end portion extends a third distance from said lower end surface, and (ii) said proximal end surface of said flexible retention member extends a second distance away from said lower end surface, when said flexible retention member is in said undeflected configuration, wherein said third distance is between 2 and 3 times greater than said second distance.

6. The closure in accordance with claim 3 in which said flexible retention member includes a flat distal end surface oriented an angle $\alpha 2$ of between 25 and 35 degrees relative to a horizontal plane defined by said access passage when said flexible retention member is in said undeflected configuration.

7. The closure in accordance with claim 1 in which said flexible retention member is movable between said initial, undeflected configuration to said deflected configuration when subjected to an axial force of between 100 Newtons and 150 Newtons.

8. The closure in accordance with claim 3 in which said flexible retention member has a maximum, first thickness at its distal end and a minimum, second thickness at said connection with said skirt lower end portion, wherein said flexible retention member has a tapered configuration such that said first thickness is greater than said second thickness.

9. The closure in accordance with claim 8 in which said first thickness is between 1.3 and 4 times greater than said second thickness.

10. The closure in accordance with claim 3 in which said flexible retention member has a uniform thickness.

11. The closure in accordance with claim 3 in which said flexible retention member extends radially and axially inwardly from said skirt lower end portion at an angle $\alpha 1$ of between 25 degrees and 35 degrees relative to a vertical axis extending through said connection between said flexible retention member and said skirt lower end portion.

12. The closure in accordance with claim 3 in which said flexible retention member includes a flat, distal side surface when viewed in a vertical cross-sectional plane taken through a central axis of said closure, wherein said flat, distal end surface is configured to face said container when said flexible retention member is in said deflected configuration.

13. The closure in accordance with claim 1 in which said lower end portion defines an annular, lower end surface, and said flexible retention member includes a proximal end surface located at said connection between said flexible retention member and said skirt lower end portion, said proximal end surface and said lower end surface together defining a shoulder when said flexible retention member is in said undeflected configuration.

14. The closure in accordance with claim 2 in which said flexible retention member includes an arcuate distal end surface that faces toward said interior surface of said skirt when said flexible retention member is in said deflected configuration, and that is closer to said interior surface when said flexible retention member is in said deflected configuration than when said flexible retention member is in said initial, undeflected configuration.

15. The closure in accordance with claim 3 in which said closure is unitarily molded from polypropylene or polyethylene.

16. The closure in accordance with claim 3 in combination with a container of a substance.

17. The closure in accordance with claim 3 in which said interior surface of said skirt includes at least one frustoconical reinforcement portion confronting said flexible retention member in its deflected configuration.

* * * * *